US010519953B2

(12) United States Patent
Morishita et al.

(10) Patent No.: US 10,519,953 B2
(45) Date of Patent: Dec. 31, 2019

(54) ROTARY COMPRESSOR

(71) Applicant: FUJITSU GENERAL LIMITED, Kanagawa (JP)

(72) Inventors: Taku Morishita, Kanagawa (JP); Motonobu Furukawa, Kanagawa (JP); Hiroki Katayama, Kanagawa (JP); Koji Ukai, Kanagawa (JP); Naoto Tada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 302 days.

(21) Appl. No.: 15/801,961

(22) Filed: Nov. 2, 2017

(65) Prior Publication Data

US 2018/0135629 A1 May 17, 2018

(30) Foreign Application Priority Data

Nov. 16, 2016 (JP) ..... 2016-223404

(51) Int. Cl.
*F04C 18/356* (2006.01)
*F04C 23/00* (2006.01)

(52) U.S. Cl.
CPC ..... *F04C 18/3564* (2013.01); *F04C 23/001* (2013.01); *F04C 23/008* (2013.01); *F04C 2230/602* (2013.01)

(58) Field of Classification Search
CPC ..... F04C 18/3562; F04C 18/3564
See application file for complete search history.

(56) References Cited

U.S. PATENT DOCUMENTS 5,676,535 A 10/1997 Bushnell
2010/0092322 A1 4/2010 Furusho et al.

FOREIGN PATENT DOCUMENTS

JP 2009-250197 A 10/2009

OTHER PUBLICATIONS

Extended European Search Report issued in corresponding EP Patent Application No. 17201808.7, dated Mar. 7, 2018.

*Primary Examiner* — Mary Davis
(74) *Attorney, Agent, or Firm* — McDermott Will & Emery LLP

(57) ABSTRACT

An upper piston of a rotary compressor is formed to satisfy $0.7\times Hcy1/1000\leq \delta ro\leq 1.2\times Hcy1/1000$, $Cro1\leq 0.1$, $Cro2\leq 0.1$, and $Cro1\times Cro2\leq 0.007$. Here, Cro1 indicates a length (mm) of an upper side piston outer circumferential chamfer portion in a height direction, and Cro2 indicates a length (mm) of the upper side piston outer circumferential chamfer portion in a normal line direction of a piston outer circumferential surface. An upper vane is formed to satisfy $0.7\times Hcy1/1000\leq \delta v\leq 1.2\times Hcy1/1000$, $Cv1\leq 0.06$, $Cv2\leq 0.06$, and $Cv1\times Cv2\leq 0.003$. Here, Cv1 indicates a length (mm) of an upper side vane ridge line chamfer portion in a height direction, and Cv2 indicates a length (mm) of the upper side vane ridge line chamfer portion in a normal line direction of a vane tip end surface.

1 Claim, 5 Drawing Sheets

ROTARY COMPRESSOR

BACKGROUND OF THE INVENTION

1. Field of the Invention

The invention relates to a rotary compressor.

2. Background Art

A rotary compressor which is used in an air conditioner or a refrigerating machine is known. The rotary compressor is provided with a compressor housing, a rotation shaft, a motor, and a compressing unit. The compressor housing forms a sealed space in which the rotation shaft, the motor, and the compressing unit are accommodated. The motor rotates the rotation shaft. The compressing unit is provided with a piston, a cylinder, an end plate, and a vane. The piston is supported by the rotation shaft, and an outer circumferential surface is formed. The cylinder accommodates the piston therein, and an inner circumferential surface that opposes the outer circumferential surface of the piston is formed. The vane is accommodated in a groove formed on the inner circumferential surface of the cylinder, and a tip end portion abuts against the outer circumferential surface of the piston, and accordingly, a cylinder chamber surrounded by the piston, the cylinder, and the end plate is divided into an inlet chamber and a compression chamber. The compressing unit compresses a refrigerant as the rotation shaft rotates. A technology in which such a rotary compressor suppresses leakage of the refrigerant during the compression, and improves the efficiency of the compressor by reducing a clearance between the piston and the end plate, a clearance between the vane and the end plate, and a chamfer between the piston and the vane (refer to JP-A-2009-250197).

However, in the rotary compressor, when the clearance between the piston and the endplate and the clearance between the vane and the end plate are extremely small, there is a problem that abnormal wear is generated in a sliding portion between each of the components, and reliability deteriorates. In the rotary compressor, when all of the clearance between the piston and the end plate, the clearance between the vane and the end plate, and the chamfer between the piston and the vane are reduced, a feeding amount of lubricant oil to the compressing unit decreases, and as a result, there is a problem that deterioration of compression performance or deterioration of reliability occurs.

SUMMARY OF THE INVENTION

An object of the invention is to provide a rotary compressor which compresses a refrigerant with high efficiency.

A rotary compressor of the invention includes a sealed vertically-placed cylindrical compressor housing which is provided with a discharge pipe in an upper portion thereof and is provided with an inlet pipe in a lower portion of a side surface thereof, a motor which is disposed on the inside of the compressor housing, and a compressing unit which is disposed below the motor on the inside of the compressor housing, is driven by the motor, compresses a refrigerant suctioned via the inlet pipe, and discharges the refrigerant from the discharge pipe. The compressing unit includes an annular cylinder, an end plate which blocks an end portion of the cylinder, an eccentric portion which is provided in a rotation shaft rotated by the motor, a piston which is fitted to the eccentric portion, revolves along an inner circumferential surface of the cylinder, and forms a cylinder chamber in the cylinder, and a vane which protrudes from a vane groove provided in the cylinder to the inside of the cylinder chamber, abuts against the piston, and divides the cylinder chamber into an inlet chamber and a compression chamber. The piston is formed to satisfy the following expressions:

$$0.7\times Hcy1/1000\leq \delta ro\leq 1.2\times Hcy1/1000,$$

$$Cro1\leq 0.1,$$

$$Cro2\leq 0.1, \text{ and}$$

$$Cro1\times Cro2\leq 0.007,$$

by using a cylinder height Hcy1, a piston height clearance width δro, a first piston outer circumferential chamfer length Cro1, and a second piston outer circumferential chamfer length Cro2. The cylinder height Hcy1 indicates a height (mm) of the cylinder chamber in a height direction which is parallel to a rotation axial line about which the rotation shaft rotates. The piston height clearance width δro indicates a width (mm) of the clearance between the piston and the end plate in the height direction. The first piston outer circumferential chamfer length Cro1 indicates a length (mm) of a piston outer circumferential chamfer portion formed between an outer circumferential surface that slidably comes into contact with the vane in the piston and a piston end surface which opposes the end plate in the piston, in the height direction. The second piston outer circumferential chamfer length Cro2 indicates a length (mm) of the piston outer circumferential chamfer portion in a normal line direction of the outer circumferential surface. The vane is formed to satisfy the following expressions:

$$0.7\times Hcy1/1000\leq \delta v\leq 1.2\times Hcy1/1000,$$

$$Cv1\leq 0.06,$$

$$Cv2\leq 0.06, \text{ and}$$

$$Cv1\times Cv2\leq 0.003,$$

by using a vane height clearance width δv, a first vane ridge line chamfer length Cv1, and a second vane ridge line chamfer length Cv2. The vane height clearance width δv indicates a width (mm) of the clearance between the vane and the end plate in the height direction. The first vane ridge line chamfer length Cv1 indicates a length (mm) of a vane ridge line chamfer portion which is formed between the tip end surface that slidably comes into contact with the piston in the vane and the vane end surface that opposes the end plate in the vane, in the height direction. The second vane ridge line chamfer length Cv2 indicates a length (mm) of the vane ridge line chamfer portion in a normal line direction of the tip end surface.

The rotary compressor of the invention can compress the refrigerant with high efficiency.

DETAILED DESCRIPTION OF THE INVENTION

Hereinafter, the invention will be described in detail with reference to the drawings based on an aspect (example) for realizing the invention.

Example

Figure 1:
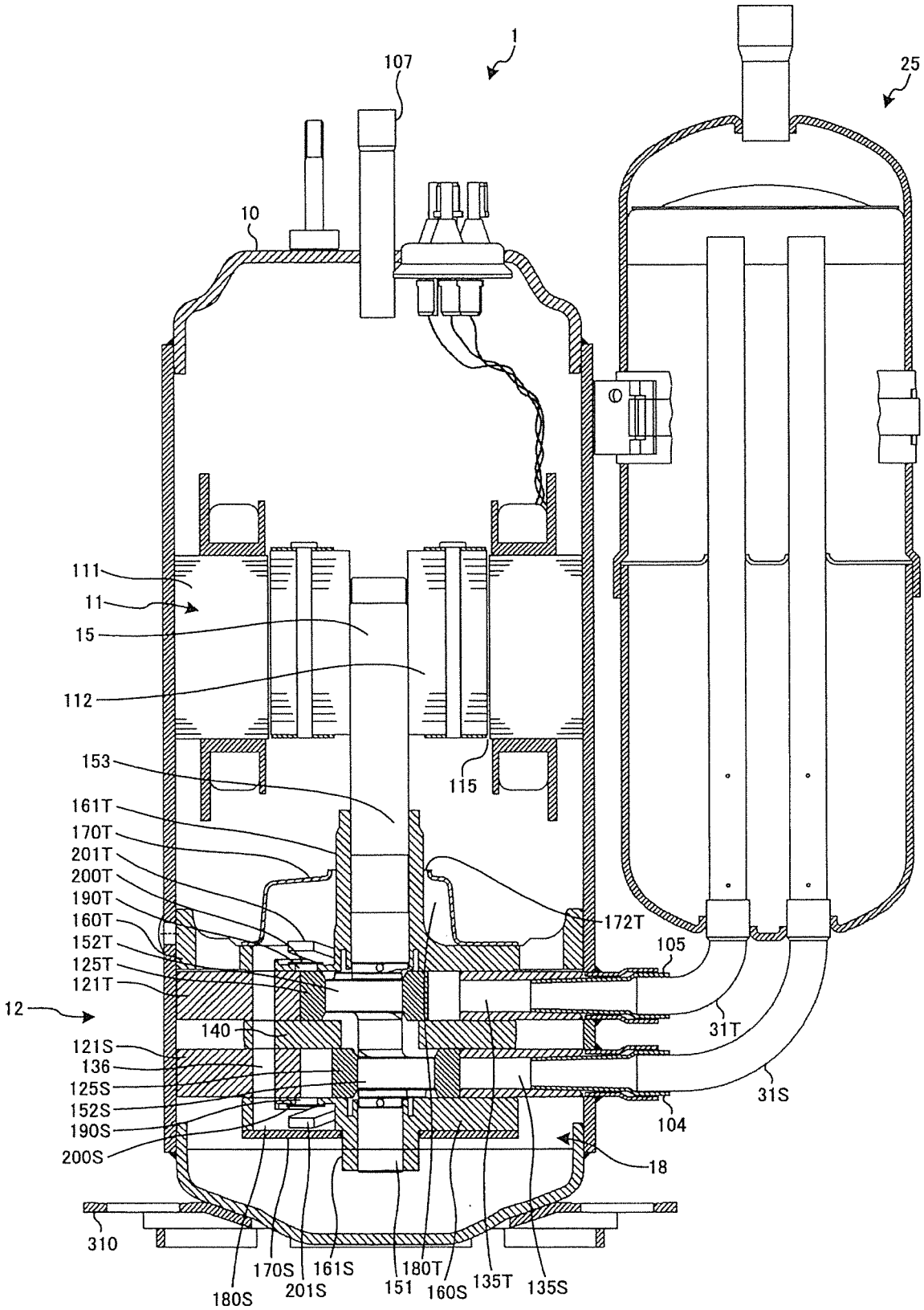
FIG. 1 is a longitudinal sectional view illustrating an example of a rotary compressor according to the invention.
Figure 2:
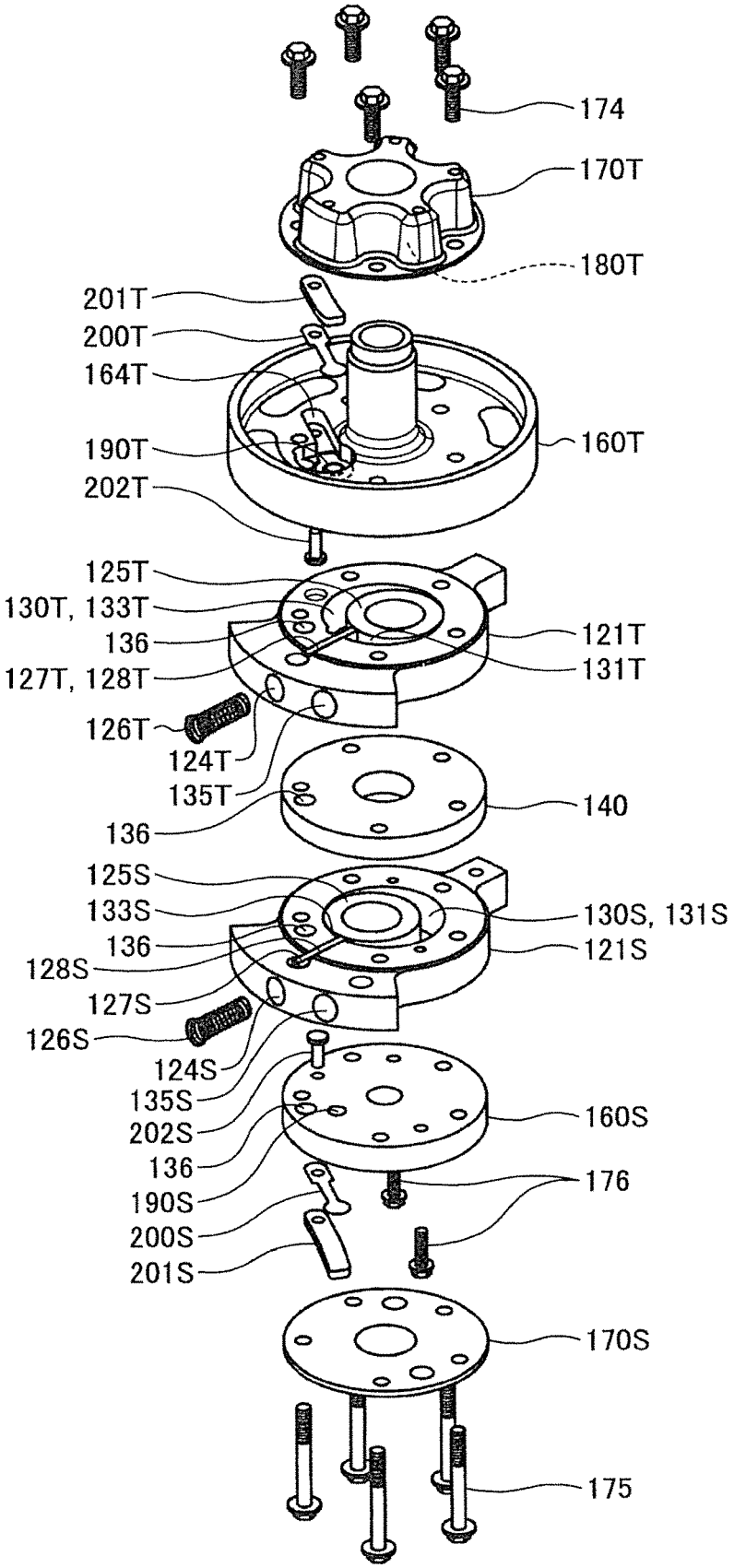
FIG. 2 is an upward exploded perspective view illustrating a compressing unit of the rotary compressor of the example.
Figure 3:
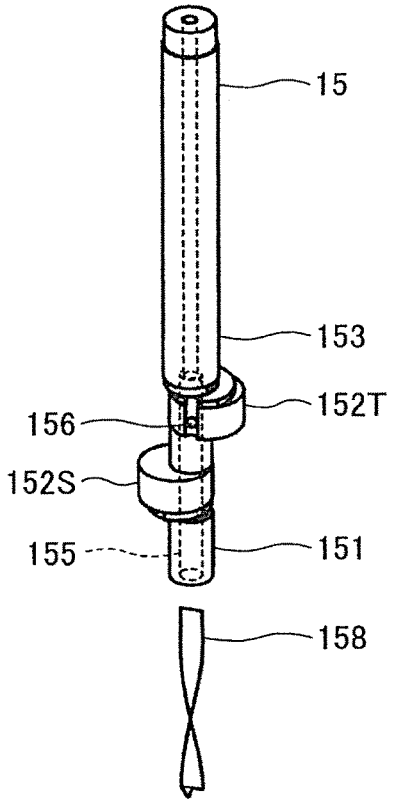
FIG. 3 is an upward exploded perspective view illustrating a rotation shaft and an oil feeding impeller of the rotary compressor of the example.

FIG. 1 is a longitudinal sectional view illustrating an example of a rotary compressor according to the invention, FIG. 2 is an upward exploded perspective view illustrating a compressing unit of the rotary compressor of the example, and FIG. 3 is an upper exploded perspective view illustrating a rotation shaft and an oil feeding impeller of the rotary compressor of the example.

As illustrated in FIG. 1, a rotary compressor 1 includes a compressing unit 12 which is disposed at a lower portion in a sealed vertically-placed cylindrical compressor housing 10, a motor 11 which is disposed above the compressing unit 12 and drives the compressing unit 12 via a rotation shaft 15, and a vertically-placed cylindrical accumulator 25 which is fixed to a side portion of the compressor housing 10.

The accumulator 25 is connected to an upper inlet chamber 131T (refer to FIG. 2) of an upper cylinder 121T via an upper inlet pipe 105 and an accumulator upper curved pipe 31T, and is connected to a lower inlet chamber 131S (refer to FIG. 2) of a lower cylinder 121S via a lower inlet pipe 104 and an accumulator lower curved pipe 31S.

The motor 11 includes a stator 111 on an outer side and a rotor 112 on an inner side, and the stator 111 is fixed to an inner circumferential surface of the compressor housing 10 by shrink fit or welding, and the rotor 112 is fixed to the rotation shaft 15 by shrink fit.

In the rotation shaft 15, a sub-shaft unit 151 at a lower part of a lower eccentric portion 152S is supported by a sub-bearing unit 161S provided on a lower end plate 160S to be freely rotatable, a main shaft unit 153 at an upper part of an upper eccentric portion 152T is supported by a main bearing unit 161T provided on an upper end plate 160T to be freely rotatable, the upper eccentric portion 152T and the lower eccentric portion 152S which are provided with a phase difference from each other by 180 degrees are respectively fitted to an upper piston 125T and a lower piston 125S to be freely rotatable, and the upper piston 125T and the lower piston 125S are allowed to perform an orbital motion respectively along inner circumferential surfaces of the upper cylinder 121T and the lower cylinder 121S by the rotation.

On the inside of the compressor housing 10, in order to lubricate a component that configures the compressing unit 12 and to seal an upper compression chamber 133T (refer to FIG. 2) and a lower compression chamber 133S (refer to FIG. 2), lubricant oil 18 is sealed only by an amount by which the compressing unit 12 is substantially immersed. As a component to be lubricated, the upper cylinder 121T, the lower cylinder 121S, the upper piston 125T, the lower piston 125S, an intermediate partition plate 140, the upper end plate 160T, and the lower end plate 160S, are described as examples. On a lower side of the compressor housing 10, an attachment leg 310 which locks a plurality of elastic supporting members (not illustrated) which supports the entire rotary compressor 1 is fixed.

As illustrated in FIG. 2, the compressing unit 12 is configured to laminate an upper endplate cover 170T which has a dome-shaped bulging portion, the upper end plate 160T, the upper cylinder 121T, the intermediate partition plate 140, the lower cylinder 121S, the lower end plate 160S, and a plate-shaped lower end plate cover 170S, from above. The entire compressing unit 12 is fixed by plurality of penetrating bolts 174 and 175 and an auxiliary bolt 176 which are disposed on a substantially concentric circle from above.

In the annular upper cylinder 121T, an upper inlet hole 135T which is fitted to the upper inlet pipe 105 is provided. In the annular lower cylinder 121S, a lower inlet hole 135S which is fitted to the lower inlet pipe 104 is provided. In addition, in an upper cylinder chamber 130T of the upper cylinder 121T, the upper piston 125T is disposed. In a lower cylinder chamber 130S of the lower cylinder 121S, the lower piston 125S is disposed.

In the upper cylinder 121T, an upper vane groove 128T which extends outward in a radial direction from the center of the upper cylinder chamber 130T is provided, and in the upper vane groove 128T, an upper vane 127T is disposed. In the lower cylinder 121S, a lower vane groove 128S which extends outward in a radial direction from the center of the lower cylinder chamber 130S is provided, and in the lower vane groove 128S, a lower vane 127S is disposed.

In the upper cylinder 121T, an upper spring hole 124T is provided at a depth that does not penetrate the upper cylinder chamber 130T at a position which overlaps the upper vane groove 128T from the outside surface, and an upper spring 126T is disposed in the upper spring hole 124T. In the lower cylinder 121S, a lower spring hole 124S is provided at a depth that does not penetrate the lower cylinder chamber 130S at a position which overlaps the lower vane groove 128S from the outside surface, and a lower spring 126S is disposed in the lower spring hole 124S.

An upper side of the upper cylinder chamber 130T is blocked by the upper end plate 160T, and a lower side of the upper cylinder chamber 130T is blocked by the intermediate partition plate 140. An upper side of the lower cylinder chamber 130S is blocked by the intermediate partition plate 140, and a lower side of the lower cylinder chamber 130S is blocked by the lower end plate 160S.

The upper cylinder chamber 130T is divided into the upper inlet chamber 131T which communicates with the upper inlet hole 135T, and the upper compression chamber 133T which communicates with an upper discharge hole 190T provided on the upper end plate 160T, as the upper vane 127T is pressed to the upper spring 126T and abuts against a piston outer circumferential surface (refer to FIG. 4) of the upper piston 125T. The lower cylinder chamber 130S is divided into the lower inlet chamber 131S which communicates with the lower inlet hole 135S and the lower compression chamber 133S which communicates with a lower discharge hole 190S provided on the lower end plate 160S, as the lower vane 127S is pressed to the lower spring 126S and abuts against the piston outer circumferential surface 41 of the lower piston 125S.

In the upper end plate 160T, the upper discharge hole 190T which penetrates the upper end plate 160T and communicates with the upper compression chamber 133T of the upper cylinder 121T is provided, and on an exit side of the upper discharge hole 190T, an annular upper valve seat (not illustrated) which surrounds the upper discharge hole 190T is formed. On the upper end plate 160T, an upper discharge valve accommodation concave portion 164T which extends in a shape of a groove toward an outer circumference of the upper end plate 160T from the position of the upper discharge hole 190T, is formed.

In the upper discharge valve accommodation concave portion 164T, all of a reed valve type upper discharge valve 200T in which a rear end portion is fixed by an upper rivet 202T in the upper discharge valve accommodation concave portion 164T and a front portion opens and closes the upper discharge hole 190T, and an upper discharge valve cap 201T in which a rear end portion overlaps the upper discharge valve 200T and is fixed by the upper rivet 202T in the upper discharge valve accommodation concave portion 164T, and the front portion is curved (arched) in a direction in which the upper discharge valve 200T is open, and regulates an opening degree of the upper discharge valve 200T, are accommodated.

On the lower end plate 160S, the lower discharge hole 190S which penetrates the lower end plate 160S and communicates with the lower compression chamber 133S of the lower cylinder 121S is provided, and on the exit side of the lower discharge hole 190S, an annular lower valve seat which surrounds the lower discharge hole 190S is formed. On the lower end plate 160S, the lower discharge valve accommodation concave portion which extends in a shape of a groove toward the outer circumference of the lower end plate 160S from the position of the lower discharge hole 190S is formed.

In the lower discharge valve accommodation concave portion, all of a reed valve type lower discharge valve 200S in which a rear end portion is fixed by a lower rivet 202S in the lower discharge valve accommodation concave portion and a front portion opens and closes the lower discharge hole 190S, and a lower discharge valve cap 201S in which a rear end portion overlaps the lower discharge valve 200S and is fixed by the lower rivet 202S in the lower discharge valve accommodation concave portion, and the front portion is curved (arched) in a direction in which the lower discharge valve 200S is open, and regulates an opening degree of the lower discharge valve 200S, are accommodated.

Between the upper end plates 160T which tightly fixed to each other and the upper end plate cover 170T which includes the dome-shaped bulging portion, an upper end plate cover chamber 180T is formed. Between the lower end plates 160S which tightly fixed to each other and the plate-shaped lower end plate cover 170S, a lower end plate cover chamber 180S is formed. A refrigerant path hole 136 which penetrates the lower end plate 160S, the lower cylinder 121S, the intermediate partition plate 140, the upper end plate 160T, and the upper cylinder 121T, and communicates with the lower end plate cover chamber 180S and the upper end plate cover chamber 180T, is provided.

As illustrated in FIG. 3, in the rotation shaft 15, an oil feeding vertical hole 155 which penetrates from a lower end to an upper end is provided, and an oil feeding impeller 158 is pressurized to the oil feeding vertical hole 155. In addition, on the side surface of the rotation shaft 15, a plurality of oil feeding horizontal holes 156 which communicate with the oil feeding vertical hole 155 are provided.

Figure 4:
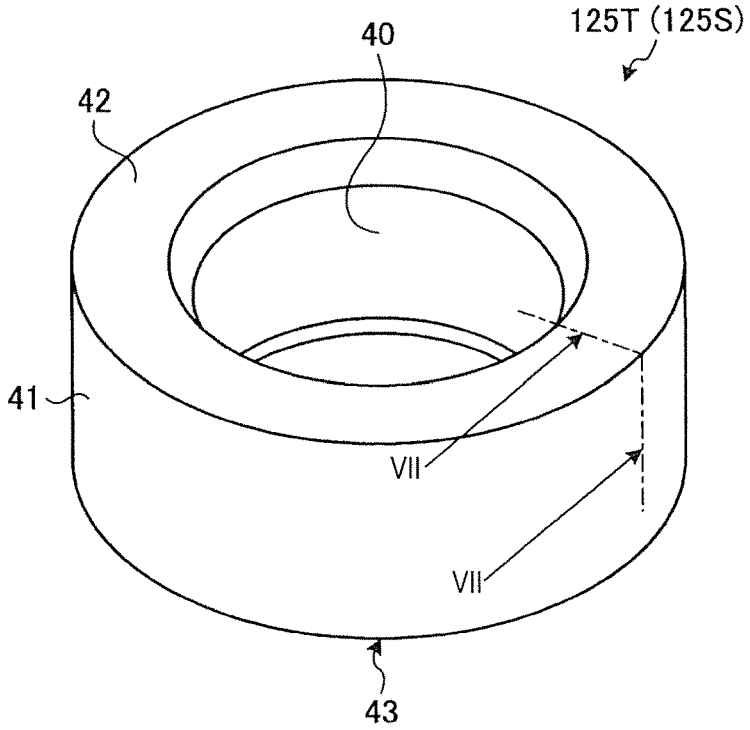
FIG. 4 is a perspective view illustrating an upper piston.

FIG. 4 is a perspective view illustrating the upper piston 125T. As illustrated in FIG. 4, the upper piston 125T is formed in a cylindrical shape and has a through hole 40 which is formed along the axis of the cylinder. In the upper piston 125T, the piston outer circumferential surface 41, a piston top end surface 42, and a piston bottom end surface 43, are formed. The piston outer circumferential surface 41 is aside surface of the upper piston 125T. The piston top end surface 42 is formed to be flat on an upper surface of the upper piston 125T. The piston bottom end surface 43 is formed to be flat on a lower face opposite to the upper surface on which the piston top end surface 42 is formed in the upper piston 125T.

The upper piston 125T is disposed in the upper cylinder chamber 130T, the upper eccentric portion 152T is fitted to the through hole 40, and accordingly, the upper piston 125T is supported by the rotation shaft 15 to be freely rotatable. As the upper piston 125T is disposed in the upper cylinder chamber 130T, the piston outer circumferential surface 41 opposes the inner circumferential surface of the upper cylinder 121T, the piston top end surface 42 opposes the upper endplate 160T, and the piston bottom end surface 43 opposes the intermediate partition plate 140.

As the rotation shaft 15 rotates, the upper piston 125T performs an orbital motion along the inner circumferential surface of the upper cylinder 121T. In the upper piston 125T, by the orbital motion, the piston outer circumferential surface 41 and the inner circumferential surface of the upper cylinder 121T slide against each other, the piston top end surface 42 and the upper end plate 160T slide against each other, and the piston bottom end surface 43 and the intermediate partition plate 140 slide against each other. In the upper piston 125T, by the orbital motion, further, the piston outer circumferential surface 41 and the tip end surface of the upper vane 127T slide against each other. The part at which the components slide against each other is a slidable portion, and the sliding portion is lubricated by the lubricant oil.

Figure 5:
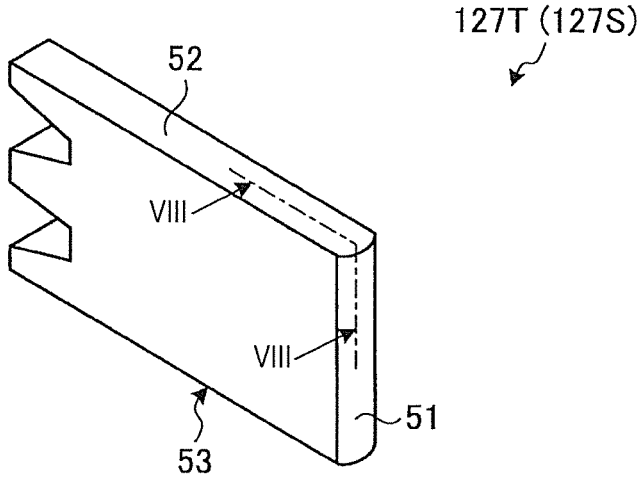
FIG. 5 is a perspective view illustrating an upper vane.

FIG. 5 is a perspective view illustrating an upper vane. As illustrated in FIG. 5, the upper vane 127T is formed in a shape of a plate, and a vane tip end surface 51, a vane top end surface 52, and a vane bottom end surface 53 are formed. The vane tip end surface 51 is formed in a so-called semicylindrical type, and the center of the upper vane 127T in a thickness direction is bent to protrude. When the upper vane 127T is disposed in the upper vane groove 128T of the upper cylinder 121T, the vane tip end surface 51 opposes the piston outer circumferential surface 41 (refer to FIG. 4) of the upper piston 125T. The vane top end surface 52 is formed to be flat, and when the upper vane 127T is disposed in the upper vane groove 128T of the upper cylinder 121T, the vane top end surface 52 is disposed at an upper end of the upper vane 127T, and opposes the upper end plate 160T. The vane bottom end surface 53 is formed to be flat, and when the upper vane 127T is disposed in the upper vane groove 128T of the upper cylinder 121T, the vane bottom end surface 53 is disposed at a lower end of the upper vane 127T, and opposes the intermediate partition plate 140.

Figure 6:
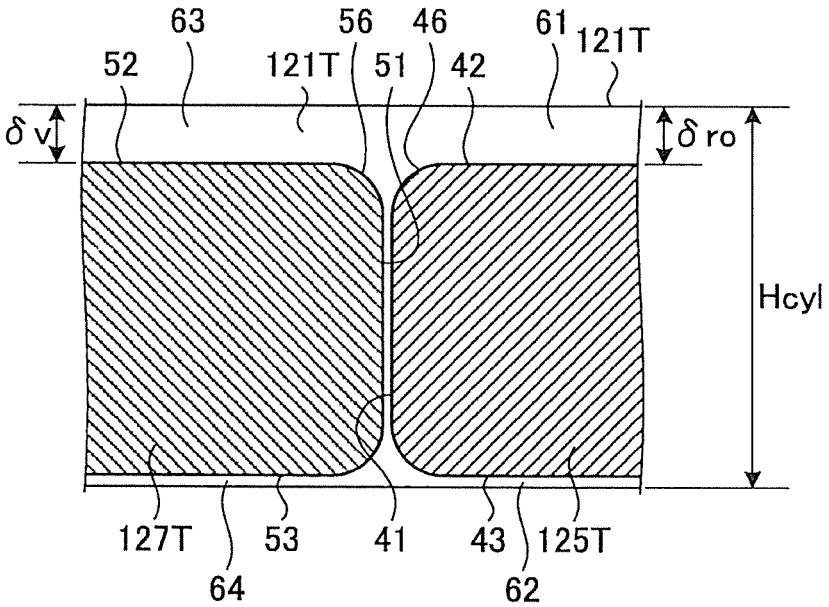
FIG. 6 is a partial sectional view illustrating an upper cylinder, the upper piston, and the upper vane.

FIG. 6 is a partial sectional view illustrating an upper cylinder, the upper piston, and the upper vane. As illustrated in FIG. 6, the upper cylinder 121T is formed such that an upper cylinder height Hcy1 increases to be higher than a height of the upper piston 125T in the height direction and the upper cylinder height Hcy1 increases to be higher than a height of the upper vane 127T in the height direction. The height direction is parallel to a rotation axial line about which the rotation shaft 15 rotates. The upper cylinder height Hcy1 indicates the height of the upper cylinder chamber 130T in the height direction, that is, the height (mm) of the upper cylinder 121T.

When the compressing unit 12 compresses the refrigerant, the upper piston 125T is formed such that a first piston height clearance 61 and a second piston height clearance 62 are formed. The first piston height clearance 61 is formed between the piston top end surface 42 of the upper piston 125T and the upper end plate 160T. The second piston height clearance 62 is formed between the piston bottom end surface 43 of the upper piston 125T and the intermediate partition plate 140. The upper piston 125T is formed to satisfy the following expression:

$$0.7\times Hcy1/1000\leq\delta ro\leq 1.2\times Hcy1/1000$$

by using an upper piston height clearance width δro. Here, the upper piston height clearance width δro indicates the width (mm) of the clearance between the upper piston 125T, and the upper end plate 160T and the intermediate partition plate 140, in the height direction. In other words, the upper piston height clearance width δro indicates a difference obtained by subtracting the height of the upper piston 125T from the upper cylinder height Hcy1. Therefore, the upper piston height clearance width δro indicates the width of the first piston height clearance 61 in the height direction when the width of the second piston height clearance 62 in the height direction is set to be 0 in design.

The upper vane 127T is formed such a first vane height clearance 63 and a second vane height clearance 64 are formed when the compressing unit 12 compresses the refrigerant. The first vane height clearance 63 is formed between the vane top end surface 52 of the upper vane 127T and the upper end plate 160T. The second vane height clearance 64 is formed between the vane bottom end surface 53 of the upper vane 127T and the intermediate partition plate 140. The upper vane 127T is formed to satisfy the following expression:

$$0.7\times Hcy1/1000\leq\delta ro\leq 1.2\times Hcy1/1000$$

by using an upper vane height clearance width δv. Here, the upper vane height clearance width δv indicates the width (mm) of the clearance between the upper vane 127T, and the upper end plate 160T and the intermediate partition plate 140, in the height direction. In other words, the upper vane height clearance width δv indicates a difference obtained by subtracting the height of the upper vane 127T from the upper cylinder height Hcy1. Therefore, the upper vane height clearance width δv indicates the width of the first vane height clearance 63 in the height direction when the width of the second vane height clearance 64 in the height direction is set to be 0 in design.

Figure 7:
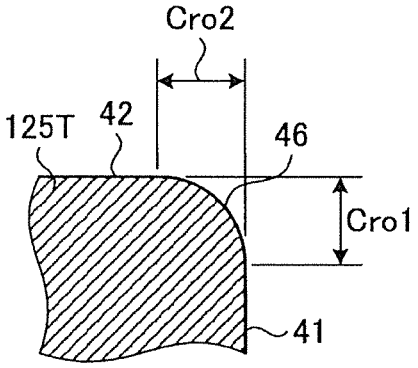
FIG. 7 is a partial sectional view taken along a line VII-VII in FIG. 4.

FIG. 7 is a partial sectional view taken along a line VII-VII in FIG. 4. As illustrated in FIG. 7, in the upper piston 125T, an upper side piston outer circumferential chamfer portion 46 is formed. The upper side piston outer circumferential chamfer portion 46 is formed between the piston outer circumferential surface 41 and the piston top end surface 42. The upper side piston outer circumferential chamfer portion 46 is formed as a ridge line between the piston outer circumferential surface 41 and the piston top end surface 42 is chamfered in the middle of making the upper piston 125T. The chamfering is performed for removing burrs formed in the ridge line between the piston outer circumferential surface 41 and the piston top end surface 42, or the like. In other words, the upper side piston outer circumferential chamfer portion 46 is formed at an upper end of the piston outer circumferential surface 41, is formed not to be along a virtual surface on which the piston outer circumferential surface 41 extends in the height direction, and is formed not to be disposed on the same plane as the piston top end surface 42.

The upper piston 125T is formed to satisfy the following expressions $$Cro1\leq 0.1,$$

$$Cro2\leq 0.1, \text{ and}$$

$$Cro1\times Cro2\leq 0.007,$$

by using a first piston outer circumferential chamfer length Cro1 and a second piston outer circumferential chamfer length Cro2. Here, the first piston outer circumferential chamfer length Cro1 indicates the length (mm) of the upper side piston outer circumferential chamfer portion 46 in the height direction. The second piston outer circumferential chamfer length Cro2 indicates the length (mm) of the upper side piston outer circumferential chamfer portion 46 in the normal line direction of the piston outer circumferential surface 41.

In the upper piston 125T, further, a lower side piston outer circumferential chamfer portion which is not illustrated is formed. The lower side piston outer circumferential chamfer portion is formed between the piston outer circumferential surface 41 and the piston bottom end surface 43. The lower side piston outer circumferential chamfer portion is formed as a ridge line between the piston outer circumferential surface 41 and the piston bottom end surface 43 is chamfered in the middle of making the upper piston 125T. In other words, the lower side piston outer circumferential chamfer portion is formed at a lower end of the piston outer circumferential surface 41, is formed not to be along a virtual surface on which the piston outer circumferential surface 41 extends in the height direction, and is formed not to be disposed on the same plane as the piston bottom end surface 43. The lower side piston outer circumferential chamfer portion is formed to have a size similar to that of the upper side piston outer circumferential chamfer portion 46. In other words, the lower side piston outer circumferential chamfer portion is formed such that the length (mm) of the lower side piston outer circumferential chamfer portion in the height direction is equal to or less than 0.1. The lower side piston outer circumferential chamfer portion is formed such that the length (mm) of the lower side piston outer circumferential chamfer portion in the normal line direction of the piston outer circumferential surface 41 is equal to or less than 0.1. The lower side piston outer circumferential chamfer portion is formed such that the product of the length (mm) of the lower side piston outer circumferential chamfer portion in the height direction and the length (mm) of the lower side piston outer circumferential chamfer portion in the normal line direction of the piston outer circumferential surface 41 is equal to or less than 0.007.

Figure 8:
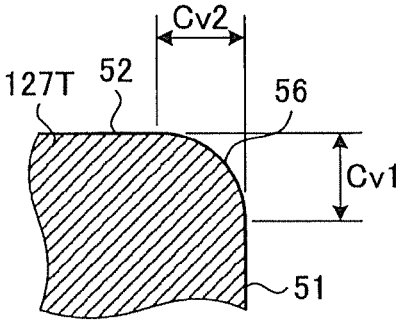
FIG. 8 is a partial sectional view taken along a line VIII-VIII in FIG. 5.

FIG. 8 is a partial sectional view taken along a line VIII-VIII in FIG. 5. In the upper vane 127T, as illustrated in FIG. 8, an upper side vane ridge line chamfer portion 56 is formed. The upper side vane ridge line chamfer portion 56 is formed between the vane tip end surface 51 and the vane top end surface 52. The upper side vane ridge line chamfer portion 56 is formed as the ridge line between the vane tip end surface 51 and the vane top end surface 52 is chamfered in the middle of making the upper vane 127T. The chamfering is performed for removing burrs formed in the ridge line between the vane tip end surface 51 and the vane top end surface 52, or the like. In other words, the upper side vane ridge line chamfer portion 56 is formed at an upper end of the vane tip end surface 51, is formed not to be disposed on the same plane as the vane tip end surface 51, and is formed not to be disposed on the same plane as the vane top end surface 52.

The upper vane 127T is formed to satisfy the following expressions:

$$Cv1 \leq 0.06,$$

$$Cv2 \leq 0.06, \text{ and}$$

$$Cv1 \times Cv2 \leq 0.003,$$

by using a first vane ridge line chamfer length Cv1 and a second vane ridge line chamfer length Cv2. Here, the first vane ridge line chamfer length Cv1 indicates the length (mm) of the upper side vane ridge line chamfer portion 56 in the height direction. The second vane ridge line chamfer length Cv2 indicates the length (mm) of the upper side vane ridge line chamfer portion 56 in the normal line direction of the vane tip end surface 51.

In the upper vane 127T, further, a lower side vane ridge line chamfer portion which is not illustrated is formed. The lower side vane ridge line chamfer portion is formed between the vane tip end surface 51 and the vane bottom end surface 53. The lower side vane ridge line chamfer portion is formed as a ridge line between the vane tip end surface 51 and the vane bottom end surface 53 is chamfered in the middle of making the upper vane 127T. In other words, the lower side vane ridge line chamfer portion is formed at a lower end of the vane tip end surface 51, is formed not to be disposed on the same plane as the vane tip end surface 51, and is formed not to be disposed on the same plane as the vane bottom end surface 53. The lower side vane ridge line chamfer portion is formed to have the size similar to that of the upper side vane ridge line chamfer portion 56. In other words, the lower side vane ridge line chamfer portion is formed such that the length (mm) of the lower side vane ridge line chamfer portion in the height direction is equal to or less than 0.06. The lower side vane ridge line chamfer portion is formed such that the length (mm) of the lower side vane ridge line chamfer portion in the normal line direction of the vane tip end surface 51 is equal to or less than 0.06. The lower side vane ridge line chamfer portion is formed such that the product of the length (mm) of the lower side vane ridge line chamfer portion in the height direction and the length (mm) of the lower side vane ridge line chamfer portion in the normal line direction of the vane tip end surface 51 is equal to or less than 0.003.

The lower piston 125S is formed similar to the upper piston 125T. In other words, in the lower piston 125S, the piston outer circumferential surface, the piston top end surface, and the piston bottom end surface are formed. The lower piston 125S is formed to satisfy the following expression:

$$0.7 \times Hcy1'/1000 \leq \delta ro' \leq 1.2 \times Hcy1'/1000,$$

by using a lower cylinder height Hcy1' and a lower piston height clearance width δro'. Here, the lower cylinder height Hcy1' indicates the height of the lower cylinder chamber 130S in the height direction, that is, the height (mm) of the lower cylinder 121S. A lower piston height clearance width δro indicates the width (mm) of the clearance between the lower piston 125S, and the intermediate partition plate 140 and the lower end plate 160S, in the height direction. In other words, the lower piston height clearance width δro' indicates a difference obtained by subtracting the height of the lower piston 125S from the lower cylinder height Hcy1'. Therefore, the lower piston height clearance width δro' indicates the width of the clearance between the piston bottom end surface of the lower piston 125S and the lower end plate 160S when the width of the clearance between the piston top end surface of the lower piston 125S and the intermediate partition plate 140 is set to be 0 in design.

In the lower piston 125S, an upper side piston outer circumferential chamfer portion is formed between the piston outer circumferential surface and the piston top end surface, and the lower side piston outer circumferential chamfer portion is formed between the piston outer circumferential surface and the piston bottom end surface. The upper side piston outer circumferential chamfer portion and the lower side piston outer circumferential chamfer portion are respectively formed to have the size similar to that of the upper side piston outer circumferential chamfer portion 46 and the lower side piston outer circumferential chamfer portion in the above-described upper piston 125T. For example, the upper side piston outer circumferential chamfer portion of the lower piston 125S is formed to satisfy the following expressions:

$$Cro1' \leq 0.1,$$

$$Cro2' \leq 0.1, \text{ and}$$

$$Cro1' \times Cro2' \leq 0.007,$$

by using a first piston outer circumferential chamfer length Cro1' and a second piston outer circumferential chamfer length Cro2'. Here, the first piston outer circumferential chamfer length Cro1' indicates the length (mm) of the upper side piston outer circumferential chamfer portion in the height direction. The second piston outer circumferential chamfer length Cro2' indicates the length (mm) of the upper side piston outer circumferential chamfer portion in the normal line direction of the piston outer circumferential surface 41.

Similar to the upper vane 127T, the lower vane 127S is formed. In other words, the vane tip end surface, the vane top end surface, and the vane bottom end surface are formed. The lower vane 127S is formed to satisfy the following expression:

$$0.7 \times Hcy1'/1000 \leq \delta v' \leq 1.2 \times Hcy1'/1000$$

by using a lower vane height clearance width δv'. Here, the lower vane height clearance width δv' indicates the width (mm) of the clearance between the lower vane 127S, and the intermediate partition plate 140 and the lower end plate 160S, in the height direction. In other words, the lower vane height clearance width δv' indicates a difference obtained by subtracting the height of the lower vane 127S from the lower cylinder height Hcy1'. Therefore, the lower vane height clearance width δv' indicates the width of the clearance between the vane top end surface of the lower vane 127S and the intermediate partition plate 140 when the width of the clearance between the vane bottom end surface of the lower vane 127S and the lower end plate 160S is set to be 0 in design.

In the lower vane 127S, the upper side vane ridge line chamfer portion is formed between the vane tip end surface and the vane top end surface, and the lower side vane ridge line chamfer portion is formed between the vane tip end surface and the vane bottom end surface. The upper side vane ridge line chamfer portion and the lower side vane ridge line chamfer portion are respectively formed to have the size similar to that of the upper side vane ridge line chamfer portion 56 and the lower side vane ridge line chamfer portion in the above-described upper vane 127T. For example, the upper side vane ridge line chamfer portion of the lower vane 127S is formed to satisfy the following expressions:

$Cv1' \leq 0.06$, $Cv2' \leq 0.06$, and $Cv1' \times Cv2' \leq 0.003$, by using a first vane ridge line chamfer length Cv1' and a second vane ridge line chamfer length Cv2'. Here, the first vane ridge line chamfer length Cv1 ' indicates the length (mm) of the upper side vane ridge line chamfer portion of the lower vane 127S in the height direction. The second vane ridge line chamfer length Cv2' indicates the length (mm) of the upper side vane ridge line chamfer portion in the normal line direction of the vane tip end surface of the lower vane 127S.

Hereinafter, a flow of the refrigerant caused by the rotation of the rotation shaft 15 will be described. In the upper cylinder chamber 130T, by the rotation of the rotation shaft 15, as the upper piston 125T fitted to the upper eccentric portion 152T of the rotation shaft 15 revolves along the inner circumferential surface of the upper cylinder 121T, the refrigerant is suctioned from the upper inlet pipe 105 while the capacity of the upper inlet chamber 131T expands, the refrigerant is compressed while the capacity of the upper compression chamber 133T is reduced, and the pressure of the compressed refrigerant becomes higher than the pressure of the upper end plate cover chamber 180T on the outer side of the upper discharge valve 200T, and then, the upper discharge valve 200T is open and the refrigerant is discharged to the upper end plate cover chamber 180T from the upper compression chamber 133T. The refrigerant discharged to the upper end plate cover chamber 180T is discharged to the inside of the compressor housing 10 from an upper end plate cover discharge hole 172T (refer to FIG. 1) provided in the upper end plate cover 170T.

In addition, in the lower cylinder chamber 130S, by the rotation of the rotation shaft 15, as the lower piston 125S fitted to the lower eccentric portion 152S of the rotation shaft 15 revolves along the inner circumferential surface of the lower cylinder 121S, the refrigerant is suctioned from the lower inlet pipe 104 while the capacity of the lower inlet chamber 131S expands, the refrigerant is compressed while the capacity of the lower compression chamber 133S is reduced, and the pressure of the compressed refrigerant becomes higher than the pressure of the lower end plate cover chamber 180S on the outer side of the lower discharge valve 200S, and then, the lower discharge valve 200S is open and the refrigerant is discharged to the lower end plate cover chamber 180S from the lower compression chamber 133S. The refrigerant discharged to the lower end plate cover chamber 180S is discharged to the inside of the compressor housing 10 from the upper end plate cover discharge hole 172T (refer to FIG. 1) provided in the upper end plate cover 170T through the refrigerant path hole 136 and the upper end plate cover chamber 180T.

The refrigerant discharged to the inside of the compressor housing 10 is guided to the upper part of the motor 11 through a cutout (not illustrated) which is provided at an outer circumference of the stator 111 and vertically communicates, a void (not illustrated) of a winding unit of the stator 111, or a void 115 (refer to FIG. 1) between the stator 111 and the rotor 112, and is discharged from a discharge pipe 107 in the upper portion of the compressor housing 10.

Hereinafter, a flow of the lubricant oil 18 will be described. The lubricant oil 18 passes through the oil feeding vertical hole 155 and the plurality of oil feeding horizontal holes 156 from the lower end of the rotation shaft 15, is supplied to a sliding surface between the sub-bearing unit 161S and the sub-shaft unit 151 of the rotation shaft 15, a sliding surface between the main bearing unit 161T and the main shaft unit 153 of the rotation shaft 15, a sliding surface between the lower eccentric portion 152S of the rotation shaft 15 and the lower piston 125S, and a sliding surface between the upper eccentric portion 152T and the upper piston 125T, and lubricates each of the sliding surfaces. The lubricant oil 18 is further supplied between the upper piston 125T and the upper end plate 160T, between the upper piston 125T and the intermediate partition plate 140, between the upper vane 127T and the upper end plate 160T, between the upper vane 127T and the intermediate partition plate 140, and between the upper piston 125T and the upper vane 127T. As the lubricant oil 18 is supplied to the parts, the sliding portions at the parts are lubricated, and the parts are sealed such that the amount of the refrigerant that leaks from the parts is reduced. Furthermore, the lubricant oil 18 is supplied between the lower piston 125S and the intermediate partition plate 140, between the lower piston 125S and the lower end plate 160S, between the lower vane 127S and the intermediate partition plate 140, between the lower vane 127S and the lower end plate 160S, and between the lower piston 125S and the lower vane 127S. As the lubricant oil 18 is supplied to the parts, the sliding portions at the parts are lubricated, and the parts are sealed such that the amount of the refrigerant that leaks from the parts is reduced.

Effect of Rotary Compressor

The upper piston 125T of the rotary compressor 1 of the example is formed to satisfy the following expressions:

$0.7 \times Hcy1/1000 \leq \delta ro \leq 1.2 \times Hcy1/1000$, $Cro1 \leq 0.1$, $Cro2 \leq 0.1$, and $Cro1 \times Cro2 \leq 0.007$.

The upper vane 127T is formed to satisfy the following expressions:

$0.7 \times Hcy1/1000 \leq \delta v \leq 1.2 \times Hcy1/1000$, $Cv1 \leq 0.06$, $Cv2 \leq 0.06$, and $Cv1 \times Cv2 \leq 0.003$.

In the rotary compressor 1, as the upper piston 125T and the upper vane 127T are designed in this manner, the lubricant oil is appropriately supplied to the first piston height clearance 61, the second piston height clearance 62, the first vane height clearance 63, and the second vane height clearance 64. As the lubricant oil is appropriately supplied to the first piston height clearance 61, the second piston height clearance 62, the first vane height clearance 63, and the second vane height clearance 64, the sealing properties of the refrigerant are improved. In the rotary compressor 1, as the upper side vane ridge line chamfer portion 56, the lower side vane ridge line chamfer portion, the upper side piston outer circumferential chamfer portion 46, and the lower side piston outer circumferential chamfer portion are formed to be small in this manner, further, leakage of the refrigerant via the chamfer portions is suppressed, and the sealing properties of the refrigerant are improved. In the rotary compressor 1, as the sealing properties are improved in this manner, it is possible to improve the efficiency of compressing the refrigerant.

In addition, the lower piston 125S of the rotary compressor 1 of the example is designed such that the lower piston height clearance width δro' is included in a predetermined range similar to the upper piston 125T, and is designed such that the upper side piston outer circumferential chamfer portion and the lower side piston outer circumferential chamfer portion have a size smaller than a predetermined size. The lower vane 127S is designed such that the lower vane height clearance width δv' is included in a predetermined range similar to the upper vane 127T, and the upper side vane ridge line chamfer portion and the lower side vane ridge line chamfer portion have the size smaller than a predetermined size. In the rotary compressor 1, as the upper piston 125T and the upper vane 127T are designed in this manner, the lubricant oil is appropriately supplied to the clearance between the lower piston 125S and the lower vane 127S, and the intermediate partition plate 140. In the rotary compressor 1, as the lubricant oil is appropriately supplied to the clearance, the sealing properties of the refrigerant can be improved, and the efficiency of compressing the refrigerant can be improved. In the rotary compressor 1, as the chamfer portions of the lower piston 125S and the lower vane 127S is designed to be smaller than the predetermined size, and further, leakage of the refrigerant via the chamfer portions is suppressed, and the sealing properties of the refrigerant are improved. In the rotary compressor 1, as the sealing properties are improved in this manner, it is possible to improve the efficiency of compressing the refrigerant.

However, in the rotary compressor 1 of the above-described example, both of the upper piston 125T and the lower piston 125S are similarly formed, and both of the upper vane 127T and the lower vane 127S are similarly formed. However, in the rotary compressor 1, only one piston of the upper piston 125T or the lower piston 125S and one vane, which corresponds to the one piston, of the upper vane 127T and the lower vane 127S, is formed as described above, and the other one of the piston and the vane may be formed similar to the related art. In the rotary compressor 1, even in such a case, as the sealing properties of one piston and the vane are improved, the efficiency of compressing the refrigerant can be improved.

However, the rotary compressor 1 is a so-called twin rotary compressor including two groups of cylinders, pistons, and vanes, but the invention may be used in the so-called single rotary compressor including one group of cylinder, piston, and vane. In the single rotary compressor, the piston is formed similar to the above-described upper piston 125T, the vane is formed similar to the above-described upper vane 127T, and accordingly, similar to the above-described rotary compressor 1, the sealing properties can be improved, and the efficiency of compressing the refrigerant can be improved.

Above, the examples are described, but the examples are not limited by the above-described contents. In addition, in the above-described configuration elements, elements which can be easily assumed by those skilled in the art, elements which are substantially the same, and elements which are in a so-called equivalent range, are included. Furthermore, the above-described configuration elements can be appropriately combined with each other. Furthermore, at least one of various omissions, replacements, and changes of the configuration elements can be performed within the range that does not depart from the scope of the example.

What is claimed is:

1. A rotary compressor comprising:

a sealed vertically-placed cylindrical compressor housing which is provided with a discharge pipe in an upper portion thereof and is provided with an inlet pipe in a lower portion of a side surface thereof, a motor which is disposed on an inside of the compressor housing, and a compressing unit which is disposed below the motor on the inside of the compressor housing, is driven by the motor, compresses a refrigerant suctioned via the inlet pipe, and discharges the refrigerant from the discharge pipe, wherein the compressing unit includes an annular cylinder, an end plate which blocks an end portion of the cylinder, an eccentric portion which is provided in a rotation shaft rotated by the motor, a piston which is fitted to the eccentric portion, revolves along an inner circumferential surface of the cylinder, and forms a cylinder chamber in the cylinder, and a vane which protrudes from a vane groove provided in the cylinder to an inside of the cylinder chamber, abuts against the piston, and divides the cylinder chamber into an inlet chamber and a compression chamber, the piston is formed to satisfy the following expressions:

$$0.7\times Hcy1/1000\leq\delta ro\leq 1.2\times Hcy1/1000,$$

$$Cro1\leq 0.1,$$

$$Cro2\leq 0.1, \text{ and}$$

$$Cro1\times Cro2\leq 0.007,$$

by using a cylinder height Hcy1, a piston height clearance width δro, a first piston outer circumferential chamfer length Cro1, and a second piston outer circumferential chamfer length Cro2, where the cylinder height Hcy1 indicates a height (mm) of the cylinder chamber in a height direction which is parallel to a rotation axial line about which the rotation shaft rotates, the piston height clearance width δro indicates a width (mm) of a clearance between the piston and the end plate in the height direction, the first piston outer circumferential chamfer length Cro1 indicates a length (mm) of a piston outer circumferential chamfer portion formed between an outer circumferential surface that slidably comes into contact with the vane in the piston and a piston end surface that opposes the end plate in the piston, in the height direction, and the second piston outer circumferential chamfer length Cro2 indicates a length (mm) of the piston outer circumferential chamfer portion in a normal line direction of the outer circumferential surface, and the vane is formed to satisfy the following expressions:

$$0.7\times Hcy1/1000\leq\delta v\leq 1.2\times Hcy1/1000,$$

$$Cv1\leq 0.06,$$

$$Cv2\leq 0.06, \text{ and}$$

$$Cv1\times Cv2\leq 0.003,$$

by using a vane height clearance width δv, a first vane ridge line chamfer length Cv1, and a second vane ridge line chamfer length Cv2, where the vane height clearance width δv indicates a width (mm) of a clearance between the vane and the end plate in the height direction, the first vane ridge line chamfer length Cv1 indicates a length (mm) of a vane ridge line chamfer portion formed between a tip end surface that slidably comes into contact with the piston in the vane and a vane end surface that opposes the end plate in the vane, in the height direction, and the second vane ridge line chamfer length Cv2 indicates a length (mm) of the vane ridge line chamfer portion in a normal line direction of the tip end surface.

* * * * *